US010981039B1

(12) United States Patent
Ripp et al.

(10) Patent No.: US 10,981,039 B1
(45) Date of Patent: Apr. 20, 2021

(54) GOLF CLUB HEAD WITH ADJUSTABLE CENTER OF GRAVITY

(71) Applicant: Sumitomo Rubber Industries, Ltd., Kobe (JP)

(72) Inventors: Patrick Ripp, Huntington Beach, CA (US); Christopher Cooper, Orange, CA (US)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 16/685,460

(22) Filed: Nov. 15, 2019

(51) Int. Cl.
*A63B 53/04* (2015.01)
*A63B 53/06* (2015.01)
*A63B 60/02* (2015.01)

(52) U.S. Cl.
CPC ..... *A63B 53/06* (2013.01); *A63B 53/047* (2013.01); *A63B 60/02* (2015.10); *A63B 2053/0479* (2013.01); *A63B 2053/0491* (2013.01)

(58) Field of Classification Search
CPC ..... A63B 60/02; A63B 53/06; A63B 53/047; A63B 2053/0479; A63B 2053/0491
USPC ..... 473/324, 334, 335, 336, 337, 338, 339
See application file for complete search history.

(56) References Cited

U.S. PATENT DOCUMENTS 5,769,737 A * 6/1998 Holladay ..... A63B 53/06 473/336
6,015,354 A * 1/2000 Ahn ..... A63B 53/04 473/256
6,280,348 B1 * 8/2001 Stites ..... A63B 53/04 473/334
7,147,573 B2 12/2006 DiMarco
7,153,220 B2 12/2006 Lo
7,166,041 B2 1/2007 Evans
7,351,162 B2 4/2008 Soracco et al.
7,611,424 B2 11/2009 Nagai et al.
7,704,163 B2 4/2010 Stites et al.
7,717,803 B2 5/2010 DiMarco
7,806,782 B2 10/2010 Stites et al.
7,854,667 B2 12/2010 Gillig
7,988,568 B2 8/2011 Stites et al.
8,016,694 B2 9/2011 Llewellyn et al.
8,066,584 B2 11/2011 Stites et al.
8,206,243 B2 6/2012 Stites
8,298,096 B2 10/2012 Stites et al.
8,308,583 B2 11/2012 Morris et al.
8,435,136 B2 5/2013 Stites et al.
8,444,505 B2 5/2013 Beach et al.
8,684,862 B2 4/2014 Tavares et al.
(Continued)

*Primary Examiner* — John E Simms, Jr.
(74) *Attorney, Agent, or Firm* — Barry IP Law, P.C.

(57) ABSTRACT

A main body of a golf club head includes a topline portion, a sole portion, a heel portion, a toe portion, a striking face defining a face plane, and a rear surface opposite the striking face. A track member is at least partially nonparallel to the face plane and extends across at least a portion of the rear surface. A weight member is translatable along the track member such that the golf club head has a first center of gravity (CG) defining a first CG depth when the weight member is located in a first position, and a second CG defining a second CG depth when the weight member is located in a second position farther from the striking face than the first position. The second CG depth is greater than the first CG depth, with the CG depth measured normal to the face plane.

20 Claims, 7 Drawing Sheets

(56) References Cited

U.S. PATENT DOCUMENTS

| | | | | |
|---|---|---|---|---|
| 8,696,491 | B1 | 4/2014 | Myers | |
| 8,734,271 | B2 | 5/2014 | Beach et al. | |
| 2007/0243943 | A1* | 10/2007 | Inouye | A63B 53/0487 473/249 |
| 2007/0249432 | A1* | 10/2007 | Wu | A63B 53/04 473/340 |
| 2008/0020861 | A1* | 1/2008 | Adams | A63B 53/04 473/334 |
| 2010/0029406 | A1* | 2/2010 | Stites | A63B 53/047 473/334 |
| 2010/0041493 | A1* | 2/2010 | Clausen | A63B 53/047 473/291 |
| 2011/0207551 | A1* | 8/2011 | Breier | A63B 60/00 473/332 |
| 2012/0178549 | A1* | 7/2012 | Yoon | A63B 60/02 473/334 |
| 2013/0344976 | A1* | 12/2013 | Stites | A63B 60/52 473/291 |

* cited by examiner

GOLF CLUB HEAD WITH ADJUSTABLE CENTER OF GRAVITY

BACKGROUND

Technological advances in the golf industry have led to a significant increase in user-customized golf equipment. For example, golfers can learn their golf swing tendencies using swing tracking and ball tracking tools and then use such data in choosing a particular piece of equipment to purchase. Typical equipment choices that golfers may make to suit a particular playing style or skill level include golf ball composition, golf club shaft stiffness, shaft length, golf club head mass, and head moment of inertia.

Golf club manufacturers have long recognized this desire of golfers to customize golf equipment and introduced various ways for implementing such customizability. For example, a golfer using a golf club with interchangeable weights may be able to adjust the club's mass properties. In addition to using adjustable golf clubs to correct undesirable swing tendencies, a golfer may make golf club adjustments to accommodate different playing conditions. For manufacturers, adjustable golf clubs allow for a wider range of features with a reduced number of models that need to be separately designed and produced.

Adjustability that provides a customizable center of gravity location is of particular interest. Unintended spin is a known result of an offset of impact point from a golf club head's "sweet spot" (i.e., the normal projection of the golf club head's center of gravity onto the golf club face): low impact shots relative to the sweet spot on the club head's face launch lower with increased backspin; high impact shots launch higher with decreased backspin; toe side impact shots launch to the right with increased draw or hook spin; and heel impact shots launch to the left with increased fade or slice spin. By providing CG adjustability on a golf club, a golfer's tendency to impact a particular region of the face can be matched to a desired shot trajectory.

Commercial efforts to provide adjustability in golf clubs have focused largely wood-type golf clubs, especially drivers. Due to differences in construction and function, providing adjustability in iron-type and wedge-type golf clubs presents challenges that may not be applicable to wood-type golf clubs. For example, wood-type golf club heads are generally lighter per volume, lower in loft, and larger in volume than heads of iron-type or wedge-type golf clubs, so providing discrete weights may be easier in a wood-type golf club head. In addition, wedge-type golf clubs are generally favored over wood-type golf clubs for short-range pitch shots, chip shots, and flop shots, and thus customization options offered for wood-type or iron-type golf clubs may not be suitable for wedge-type golf clubs.

SUMMARY

The inventors sought to provide a convenient way to customize and adjust mass properties of a wedge-type golf club head. By precisely controlling the three-dimensional location of the golf club head's center of gravity using a translatable weight located behind the golf club head's striking face, a golfer can easily adjust the golf club head's mass properties to provide a desired effect on a golf shot's trajectory.

In one or more aspects of the disclosure, a wedge-type golf club, when oriented in a reference position, includes a golf club head that comprises a main body having a striking face, a track member rearward of the striking face that extends along at least a portion of the main body, and a weight member that is translatable along the track member. The weight member may be positioned such that, in a first location of the weight member along the track member, the golf club head has a first center of gravity (CG) defining a first CG depth. The weight member may be positioned such that, in a second location of the weight member along the track member different from first location, the golf club head has a second CG defining a second CG depth different from the first CG depth. A difference between the first CG depth and the second CG depth may be between about 1 mm to about 20 mm. Here, CG depth is measured normal to the face plane such that a positive CG depth corresponds to locations forward of the face plane and a negative CG depth corresponds to locations rearward of the face plane.

According to one or more embodiments of the CG depth adjustable wedge-type golf club, the first CG depth is a negative value and the second CG depth is a positive value. The first CG depth may be between −1 mm to −10 mm and the second CG depth may be between 1 mm to 10 mm.

According to one or more aspects of the disclosure, a CG depth adjustable wedge-type golf club comprises a first CG depth that is about 0 and a second CG depth whose absolute value is 1 mm to 20 mm.

In one example of one or more aspects of the disclosure, a CG depth adjustable wedge-type golf club comprises a track member extending across at least a part of a rear surface of the golf club head's main body. The track member may be non-parallel to a face plane defined by the striking face and a weight member may be translated along the track member. In another example, a CG depth adjustable wedge-type golf club comprises a main body having a sole portion having an upper surface and a lower surface; the track member may extend across at least a portion of the sole portion along one of the upper surface and the lower surface.

In one or more aspects of the disclosure, a wedge-type golf club, when oriented in a reference position, includes a golf club head that comprises a main body having a striking face, a track member rearward of the striking face that extends along at least a portion of the main body, and a weight member that is translatable along the track member. The weight member comprises a material having a density equal to or greater than the golf club head main body.

DETAILED DESCRIPTION

Representative examples of one or more novel and nonobvious aspects and features of the golf club head according to the present invention, disclosed below, are not intended to be limiting in any manner. Furthermore, the various aspects and features of the present invention may be used alone or in a variety of novel and nonobvious combinations and subcombinations with one another.

Figure 1A:
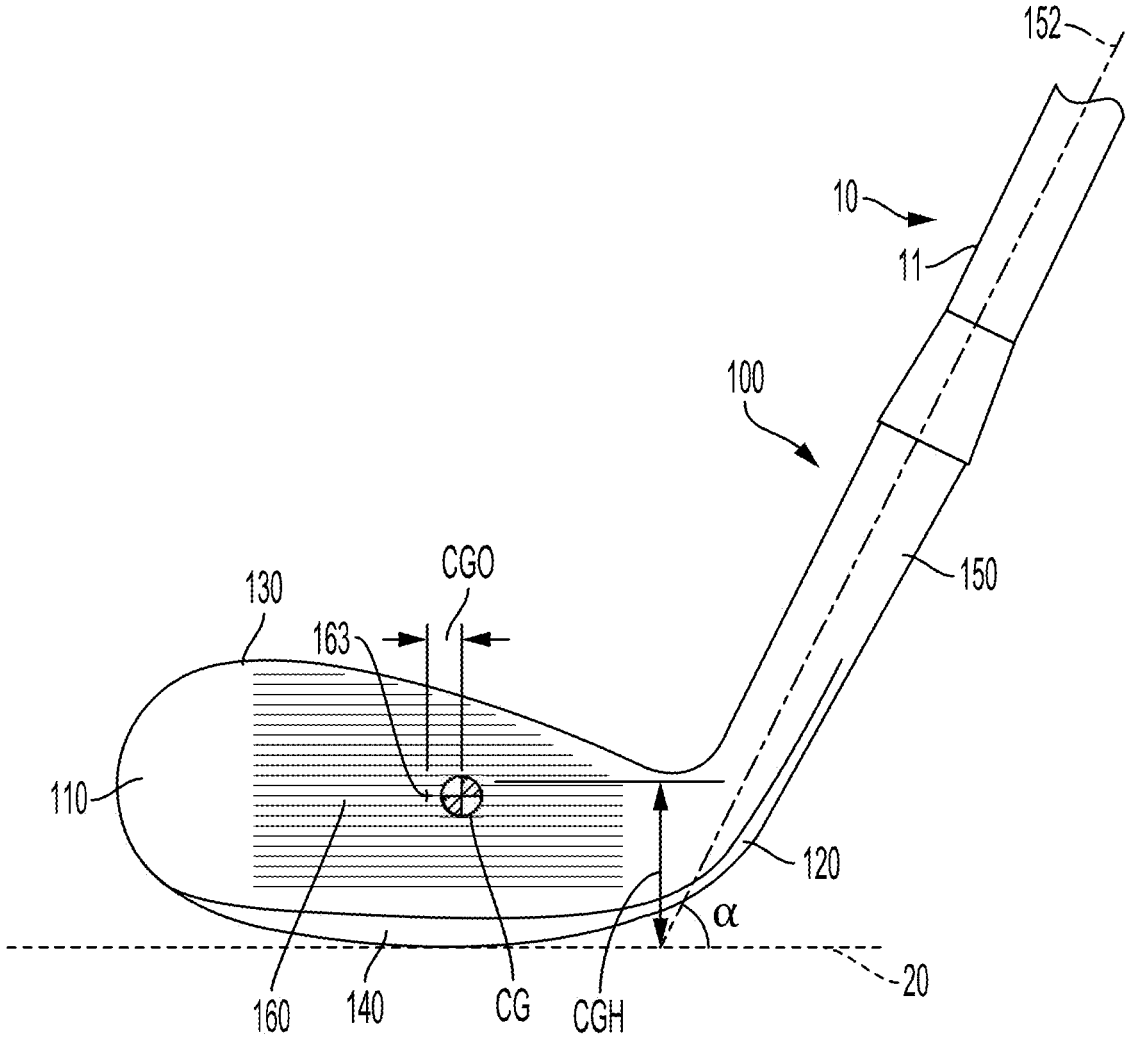
FIG. 1A is a front view of an exemplary golf club head.
Figure 1B:
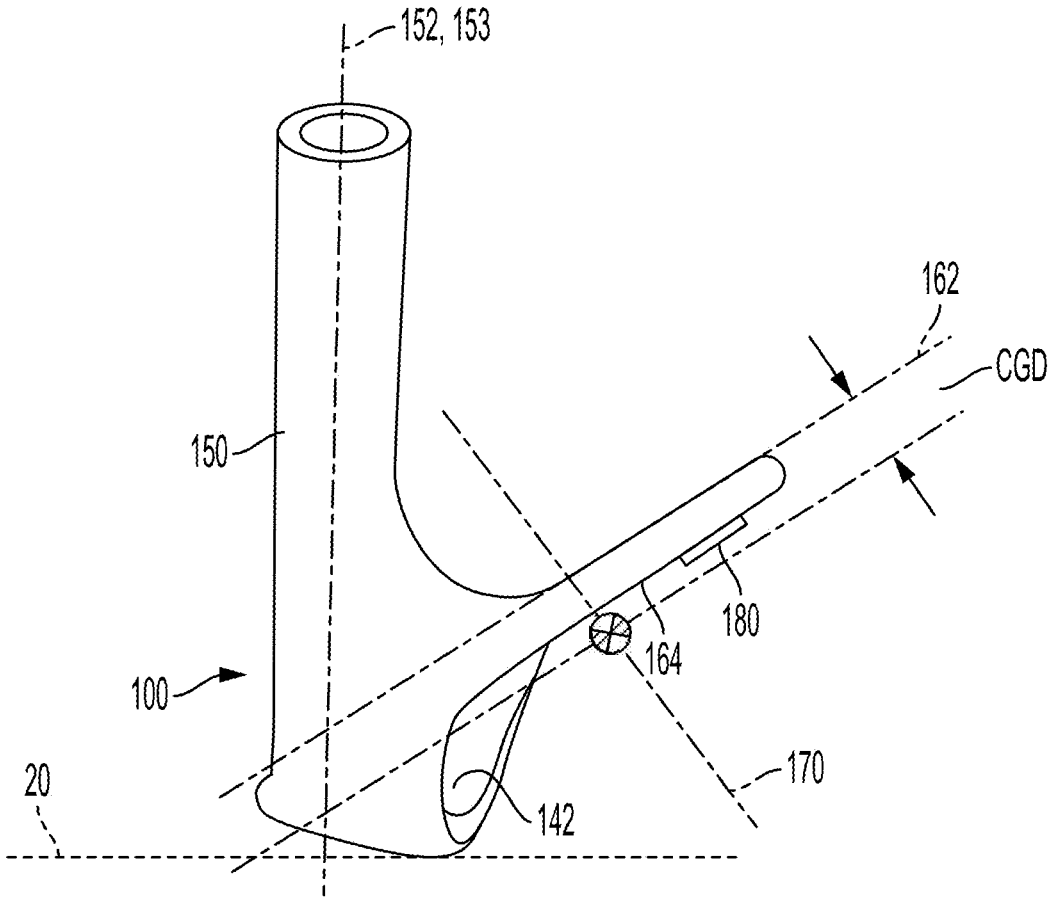
FIG. 1B is a heel side view of the exemplary golf club head.

Referring to FIGS. 1A and 1B, a golf club head 100 of a golf club 10 includes a toe portion 110, a heel portion 120, a topline portion 130, and a sole portion 140. The golf club head 100 also includes a hosel 150 that is proximate the heel portion 120 of the golf club head 100. The hosel 150 may include an open end for receiving the golf club shaft 11. As shown in FIG. 1A, the golf club head 100 includes a striking face 160 adapted to strike a conventional golf ball. The striking face 160 may be provided with one or more grooves or score lines, which imparts additional spin to the golf ball when struck. The striking face 160 defines a face plane 162 as shown in FIG. 1B and includes a face center 163.

As used herein, "face center," e.g., the face center 163, denotes a point on a golf club head's striking face that is midway between the heel-to-toe extents of the striking face score lines and midway between the sole-to-topline extents of the striking face.

The golf club head 100 also includes a center of gravity (CG), which alternatively may be referred to as a center of mass. When the golf club head 100 is oriented in a reference position as in FIGS. 1A and 1B, the golf club head 100 includes a CG height CGH, defined herein as the vertical distance of a golf club head's CG from a ground plane 20, and a CG offset CGO, defined herein as a measure of the horizontal (heel-to-toe) displacement of the golf club head's CG from its face center measured as a projection onto a face plane. Herein, a negative CGO value denotes a CG location on a toe-ward side of the face center and a positive CGO value denotes a CG location on a heel-ward side of the face center. In the configuration of the embodiment shown in FIG. 1A for example, the golf club head 100 has a CG location heel-ward of the face center and a corresponding positive CGO value.

Referring to FIG. 1B, a golf club head's CG lies along a CG depth axis 170, which is normal to the face plane 162. The golf club head 100 includes a CG depth CGD, defined herein as a measure of the displacement between the face plane 162 and the CG along the CG depth axis 170. A positive CGD value denotes a CG location that is rearward of the face plane 162. Depending on the mass distribution of a golf club head, its CG location may be forward of the face plane 162 and the corresponding CGD value may be a negative. In the embodiment shown in FIG. 1B, the golf club head 100 has CG location rearward of the face plane 162 and a positive CGD value.

As shown in FIG. 1B, the golf club head 100 includes a hosel axis 152, which extends axially through the center of the hosel 150. The hosel axis 152 lies in a virtual vertical hosel plane 153. The golf club head's loft is thereby the angle formed by the hosel plane 153 and the face plane 162 as projected in a front to rear vertical plane (e.g. in the plane of the paper as shown in FIG. 1B). A golf club set is typically made up of golf clubs with heads of a range of lofts, where higher lofted golf clubs are generally intended for shorter distances. In addition, wedge-type golf clubs may have lofts tailored to pitch shots, lob shots, or chip shots that may range from about 44 degrees to about 64 degrees. The adjustable CG arrangements discussed in more detail below can be especially advantageous for golf club heads with lofts greater than or equal to approximately 40 degrees.

As used herein, "reference position" denotes an orientation of a golf club head in which the sole rests on the virtual ground plane such that the score lines are horizontal and the virtual vertical hosel plane is parallel to the score lines. Unless otherwise indicated, all parameters of the various embodiments of the disclosure are specified with the golf club head in the reference position.

Advantageously, a translatable weight member according to various embodiments of the disclosure can be moved by a user, e.g. to adjust a golf club head's CG. For example, FIG. 1B shows a translatable weight member 180 positioned on a rear surface 164 of the golf club head 100. The translatable weight member 180 may be moved along the rear surface 164 thereby varying the CG location.

As shown in FIG. 1B, a portion of the sole portion 140 may define a sole cavity 142. In one or more embodiments, a golf club head may include a perimeter weighting element formed on at least a portion of the periphery of the rear surface thereby defining a rear wall cavity inward or centrally thereof. Alternatively, a golf club head may be a traditional muscle-back wedge without a perimeter weighting element and without a sole cavity, or where the contour of the rear surface is dominated by a muscle-blade configuration rather than peripheral weighting. The embodiments described below are shown in FIGS. 2-9 without a rearwardly extending sole for clarity of view, but it is to be understood that the golf club heads may include a rearwardly extending sole.

Figure 2:
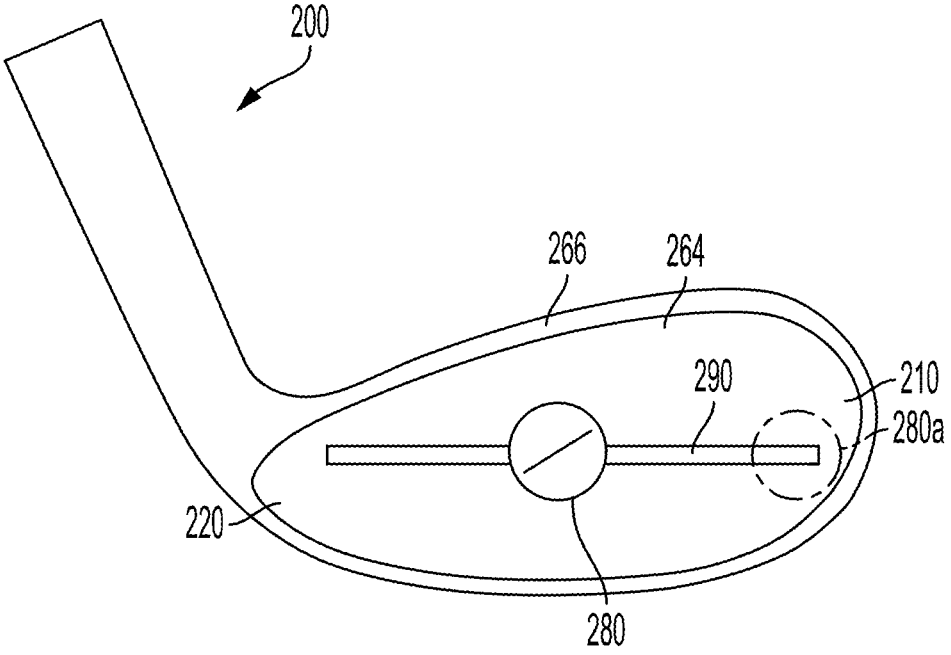
FIG. 2 is a rear view of an exemplary golf club head with a center of gravity adjustable in a heel to toe direction.

Referring to FIG. 2, a golf club head 200 includes a track member 290 on its rear surface 264. The track member 290 extends from a toe portion 210 to a heel portion 220 and is elongate in a generally heel to toe direction. The track member 290 has a length that is up to 60 mm. Preferably the track member 290 is at least 30 mm in length. The golf club head 200 includes a weight member 280 that is translatable along the track member 290. The track member 290 may have a length of about 4 cm to about 8 cm and the translatable weight member 280 may be positioned at any point along the track member 290. The golf club head 200 includes a CG that is adjustable in the heel to toe direction. Accordingly, the golf club head 200 includes a variable CG offset CGO. Depending on the position of the weight member 280 along the track member 290, the magnitude of the CG offset can range from 0 (CG and face center laterally aligned) to about 2 cm. As noted above, the CG offset can be negative with the CG toe-ward of the face center or positive with the CG heel-ward of the face center.

The golf club head 200 of FIG. 2 includes a first CGO with the weight member 280 at a first position along the track member 290, a second CGO with the weight member 280*a* at a second position along the track member 290, and a CG horizontal distance of at least 4 mm. Herein, CG horizontal distance is the difference between the first CG offset and the second CG offset. In a preferred embodiment, the CG horizontal distance is at least 4 mm and less than 20 mm, and more preferably between 8 mm and 16 mm. This range best ensures that the club head is capable of adjustment over a reasonably complete spectrum of trajectory misalignments, yet does not unduly tie up discretionary head mass necessary for the structural integrity and over-arching mass-related requirements of the club head.

In a preferred embodiment, the track member 290 is substantially horizontal when the golf club head 200 is in a reference position. In such an embodiment, the CG height CGH of the golf club head 200 remains substantially constant as the weight member 280 is translated along the track member 290. In this embodiment, the golf club head's CG location may be translated so as to correct swing tendencies associated with mishits in the heel-to-toe direction that often result in undesired slice or hook shots.

As shown in FIG. 2, the golf club head 200 may include a perimeter-weighting element 266, which defines a rear cavity region of the rear surface 264. Such a perimeter-weighting element is a common feature of iron-type golf clubs and are typically included to provide a higher moment-of-inertia in golf clubs for higher handicapped players. In the embodiments shown in FIGS. 2-10, a track member and a translatable weight member is provided in such a rear cavity region. However, a track member and a translatable weight member for adjusting club head CG location may be provided on a rear surface of a blade-type golf club head as well.

Figure 3:
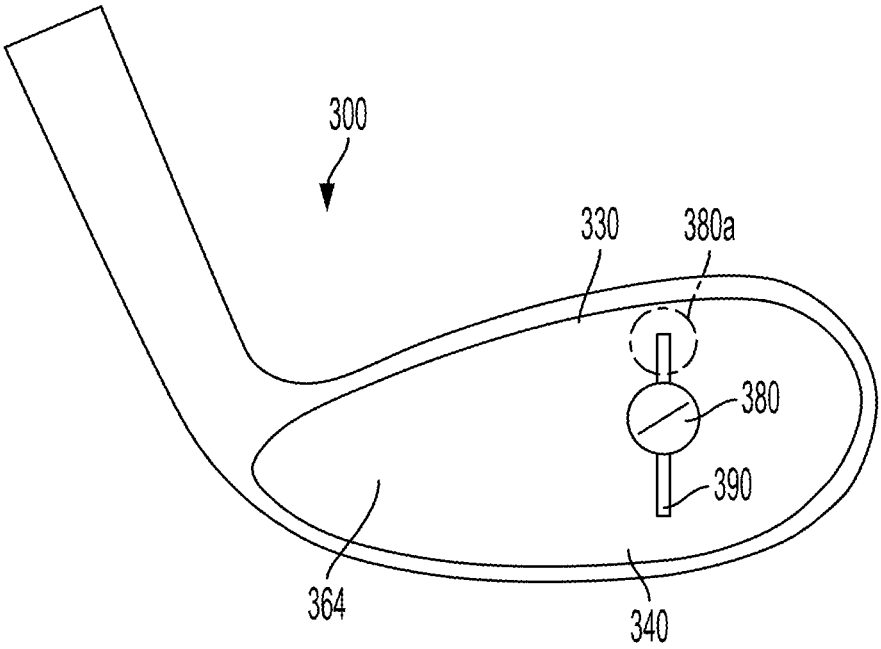
FIG. 3 is a rear view of an exemplary golf club head with a center of gravity adjustable in a sole to topline direction.

Referring to FIG. 3, a golf club head 300 includes a track member 390 on its rear surface 364. The track member 390 extends from the topline portion 330 toward the sole portion 340. The golf club head 300 includes a weight member 380 that is translatable along the track member 390. The track member 390 has a length between about 20 mm and 40 mm and the translatable weight member 380 can be translated to position along the track member 390. The golf club head 300 includes a CG that is adjustable in the topline to sole direction. Accordingly, the golf club head 300 provides for varying CG height CGH in a non-permanently or non-plastically deformable manner. Depending on the position of the weight member 380 along the track member 390, the CGH may be adjustable such that it is substantially the same as the face center height or is up to 2 cm higher or lower than the face center height. Such adjustability may be beneficial to match playing conditions (e.g., course wetness, wind speeds, etc.) and optimize spin characteristics and dynamic lofting.

The golf club head 300 of FIG. 3 includes a first CGH with the weight member 380 at a first position along the track member 390 and a second CGH with the weight member 380*a* at a second position along the track member 390. A difference between the first CGH and the second CGH is at least 1 mm. Preferably, the CG height difference is between 1 mm-10 mm.

Figure 4:
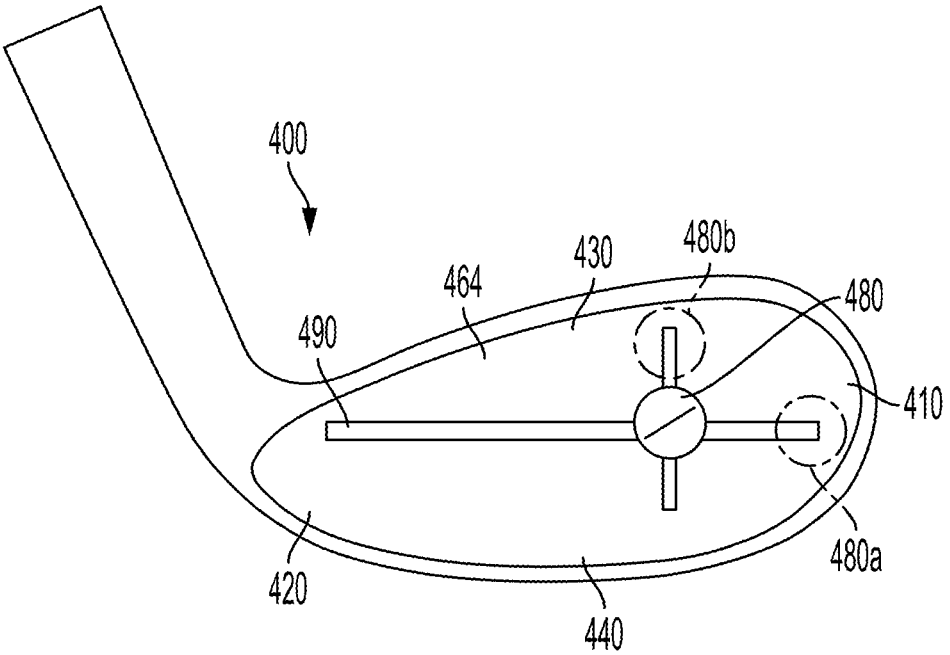
FIG. 4 is a rear view of an exemplary golf club head with a center of gravity adjustable in two directions.

Referring to FIG. 4, a golf club head 400 includes a track member 490 on its rear surface 464. The track member 490 includes a heel-toe portion that extends between a heel portion 420 and a toe portion 410. The track member 490 additionally includes a topline-sole portion that extends between the topline portion 430 and the sole portion 440. The topline-sole portion and the heel-toe portion preferably intersect at a junction. A translatable weight member 480 is coupled to the track member 490. The position of the translatable weight member 480 along the track member 490 may be changed to adjust the club head's CG location. In particular, the track member 490 and the weight member 480 may be configured such that the weight member 480 may be slideably transferred between the topline-sole portion and the heel-toe portion without removal.

The golf club head 400 of FIG. 4 includes a first CGO with the weight member 480 at a first position along the heel-toe portion of track member 490, a second CGO with the weight member 480*a* at a second position along the heel-toe portion of track member 490, and a CG horizontal distance of at least 4 mm. Herein, CG horizontal distance is the difference between the first CG offset and the second CG offset. In a preferred embodiment, the CG horizontal distance is at least 4 mm and less than 20 mm.

The golf club head 400 of FIG. 4 includes a first CGH with the weight member 480 at the first position along the topline-sole portion of track member 490 and a second CGH with the weight member 480*b* at a second position along the topline-sole portion of track member 490. A difference between the first CGH and the second CGH is at least 1 mm. Preferably, the CG height difference is between 1 mm-10 mm.

Figure 5:
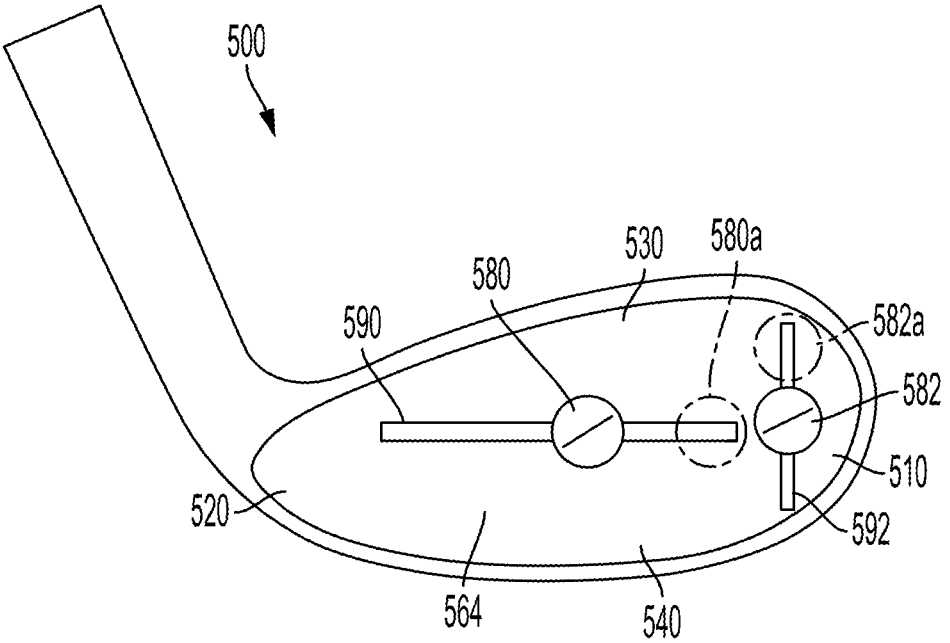
FIG. 5 is a rear view of another exemplary golf club head with a center of gravity adjustable in two directions.

In another embodiment, as shown in FIG. 5, a golf club head 500 includes a first track member 590 and a second track member 592 on its rear surface 564. The first track member 590 extends between a heel portion 520 and a toe portion 510. The second track member 592 extends between a topline portion 530 and a sole portion 540. In this embodiment, a first translatable weight member 580 and a second translatable weight member 582 are coupled to the first track member 590 and the second track member 592, respectively, and the positions of the translatable weight members 580 and 582 are changed to adjust the club head's CG location. In FIG. 5, the golf club head 500 has a first CGO and a first CGH with the first weight member 580 in a first position along the first track member 590 and the second weight member 582 in a first position along the second track member 592. The golf club head 500 has a second CGO when weight member 580*a* is moved to a second position along the first track member 590. The golf club head has a second CGH when the second weight member 582*a* is translated to a second position along the second track member 592. Advantageously, in this embodiment, one of the CGO and the CGH may be adjusted by selectively translating the first weight member 580 or the second weight member 582. Alternatively, the golf club head 500's CGO and CGH may be adjusted in conjunction to varying degrees by translating the two weight members 580 and 582 along track members 590 and 592.

Figure 6:
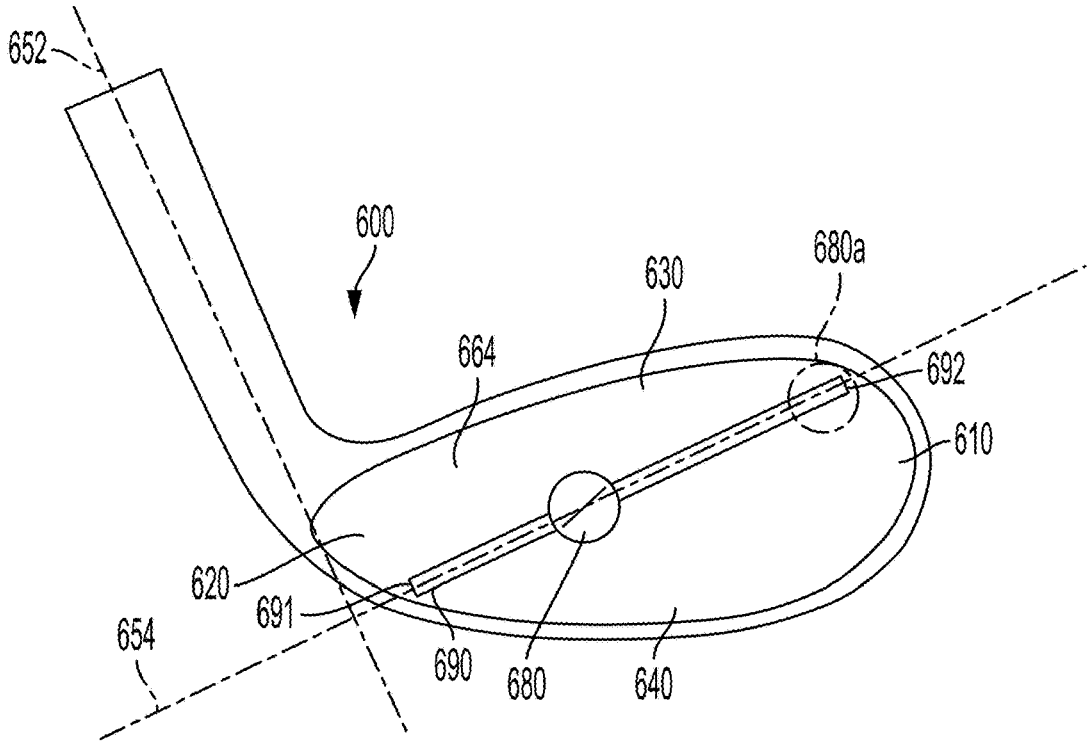
FIG. 6 is a rear view of an exemplary golf club head with a center of gravity adjustable in a low heel to high toe direction.

While FIGS. 2-5 depict embodiments of golf club heads having one or more track members with a translatable weight member that can be used to adjust a golf club head's CG height and/or its lateral CG position, the configuration of the one or more track members is not necessarily so restricted. For example, FIG. 6 shows an embodiment wherein a golf club head 600 includes a track member 690 on its rear surface 664. The track member 690 extends diagonally along the rear surface 664 and includes a first end 691 and a second end 692, with the first end 691 located more towards a heel portion 620 and a sole portion 640 of the golf club head 600 than the second end 692. In such an embodiment, a translatable weight member 680 mounted on the track member 690 is associated with a first CG location having a first CGO and first CGH of the golf club head 600. When the weight member 680*a* is in a more toe-ward second position of the track member 690, the golf club head 600 has a second CG location with a second CGH greater than the first CGH and a second CGO that is more negative than the first CGO.

Advantageously, the embodiments discussed herein may be tailored to fit a target user. For example, for a golf club intended to be used for "game improvement" (i.e., for higher less skilled golfers), horizontal shift may be more significant than vertical because the target consumer may be more concerned with correcting slice or hook, while for a wedge intended to be sold to more skilled golfers, spin adjustment is a more significant concern.

The golf club head 600 may also be adjustable in a manner that is swingweight neutral. Herein, a "swingweight neutral" refers to a weight adjustment feature where mass properties, optionally including CG location, may be varied, but in a manner such that swingweight is substantially maintained constant. For example, the feature may specifically enable the relocation of mass in a manner that does not substantially shift the specific location of the CG relative to the intended shaft axis (which may be considered to coincide with the hosel axis). A swingweight neutral golf club head describes a golf club head that, when provided as a part of a golf club with a constant shaft length, has a swingweight that does not substantially vary when a weight member is translated along a track member disposed on its rear surface. Herein, "swingweight" refers to the common golf club fitting variable related to the weight distribution in a golf club as measured on a swingweight scale in units of the Lorythmic scale. A swingweight neutral golf club head may, for example, have a swingweight of "D4" when a translatable weight member is positioned at any position of a track member of the golf club head. In other words, a golf club having a swingweight neutral golf club head has a swingweight that varies less than 1.75 inch-oz and preferably a swingweight that varies less than 0.75 inch-oz. The track member 690 is configured such that the golf club head is swingweight neutral when provided as a part of a golf club with an appropriately weighted shaft and grip.

In another example, a swingweight neutral adjustment feature may comprise a golf club with plural weight ports oriented relative to each other in such a manner that a weight interchanged among them results in a substantially constant swingweight or expected swingweight of a club head when associated with a shaft of a constant length. In other cases, plural weight ports of different locations about a club head and plural weight elements of different masses may be arranged in predetermined and known manners that result in substantially constant swingweight. In such particular cases, instructions or borne-on indicia is preferably provided for guiding the user in how to assemble weights in a manner that maintains a desired swingweight. This feature is particularly suitable for wedge-type club heads where swingweight maintenance can be a large concern with shorter conventional shaft lengths, and the likelihood that weight elements constitute a larger proportion of an overall club head mass.

The ability to adjust the CG location of a golf club head by simply translating a weight member along a track member of a golf club head without changing the golf club's swingweight can be advantageous to a golfer who has a preference for a certain swingweight. Often, swingweight is associated with how the golf club feels to the golfer during a golf swing and so changing the swingweight can adversely affect the golf club's performance and the golfer's confidence. At the same time, the golfer may, for example, prefer to position the golf club head's CG more towards the club head's toe to optimize a tendency to impact the ball on the toe side of the golf club face. A swingweight neutral golf club head, as exemplified by the golf club head 600 in FIG. 6, allows the golfer to laterally adjust the golf club's CG location (i.e., the CGO) without having to compensate for a change in the club's swingweight. As shown in FIG. 6, the weight member 680 is permitted to translate along a track located substantially entirely in a virtual plane 654 that is perpendicular to the hosel axis 652 of the club head, and in turn the intended shaft axis when the club head 600 is associated with a conventional shaft of constant length in an operational state. Other configurations of weight tracks are possible, but preferably to be swingweight neutral, are substantially confined to a virtual plane that is perpendicular to the hosel axis.

In other embodiments of the disclosure (or as additional features of any of the above embodiments), adjusting a translatable weight member's position along a track member of a head of a golf club allows a golfer to tune the golf club's swingweight to a preferred swingweight. In these embodiments, a track member extends from an upper heel portion of a rear surface of a golf club head to a lower toe portion. When the weight member is positioned at an upper heel end of the track member, the golf club has a first swingweight substantially lower than a second swingweight when the weight member is positioned at a lower toe end of the track member. Preferably, the first swingweight is at least 1.75 inch-oz less than the second swingweight. Even more preferably, the first swingweight is at least 3.50 inch-oz less than the second swingweight. Advantageously, the weight member may be positioned at other positions along the track member to allow a golfer to fine tune the golf club's swingweight.

In one embodiment, a golf club has a minimal swingweight when a weight member is positioned in a heelward most extent of the track member. The golf club has a second swingweight that is at least 1.75 inch-oz greater than the first swingweight when the weight member is positioned at a central position of the track member. The golf club has a third swingweight that is at least 3.50 inch-oz greater than the first swingweight and greater than the second swingweight when the weight member is positioned at a toemost extent of the track member.

Figure 7:
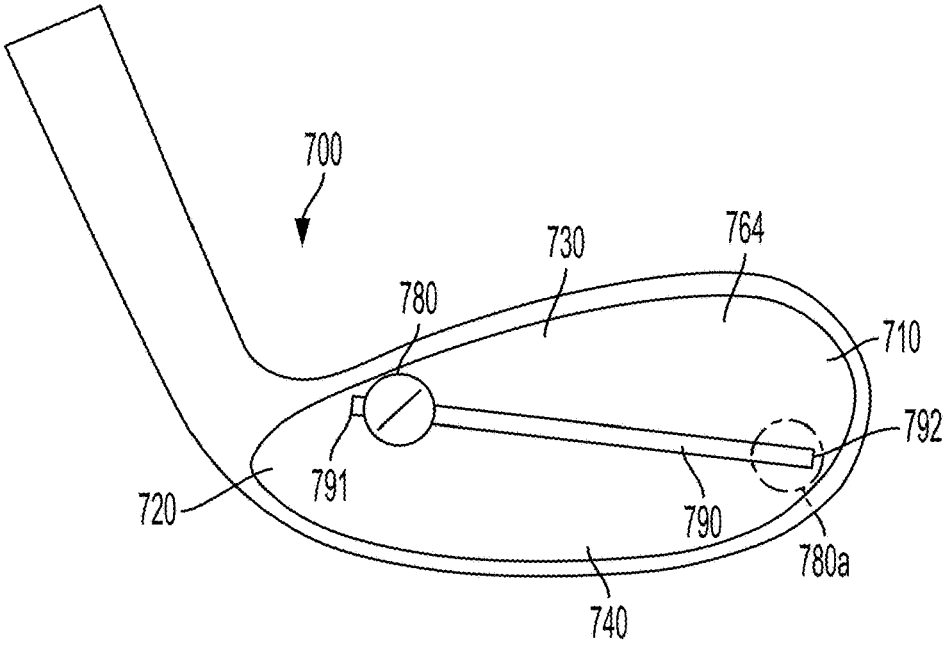
FIG. 7 is a rear view of an exemplary golf club head with a center of gravity adjustable in a high heel to low toe direction.

FIG. 7 shows an exemplary golf club head 700 with an adjustable swingweight. The golf club head 700 has a track member 790 with a first end 791 and a second end 792 with the first end 791 located more towards a heel portion 720 and a topline portion 730 of the golf club head 700 than the second end 792. In such an embodiment, a translatable weight member 780 mounted on the track member 790 is associated with a first CG location having a first CGO and first CGH of the golf club head 700. When the weight member **780*a* is in a more toe-ward second position of the track member 790, the golf club head 700** has a second CG location with a second CGH lower than the first CGH and a second CGO that is more negative than the first CGO.

In addition, the rear surface 764 of the golf club head 700 or the track member 790 may be marked by gradations or other indicia (not shown) to denote positions along the track member that correlate to a change in swingweight. The ability to adjust a golf club's swingweight provides significant benefits for golfers. Commonly, golfers affix some amount of lead tape to the golf club's head or grip to make the golf club match a desired swingweight. However, lead tape can easily come off during play and may be visually distracting or aesthetically unpleasing.

Further, the length and position of the tape placement must be optimized, which may be cumbersome without access and use of a swingweight scale. The above described swingweight adjustable golf club head embodiments make such use of lead tape unnecessary.

Figure 8:
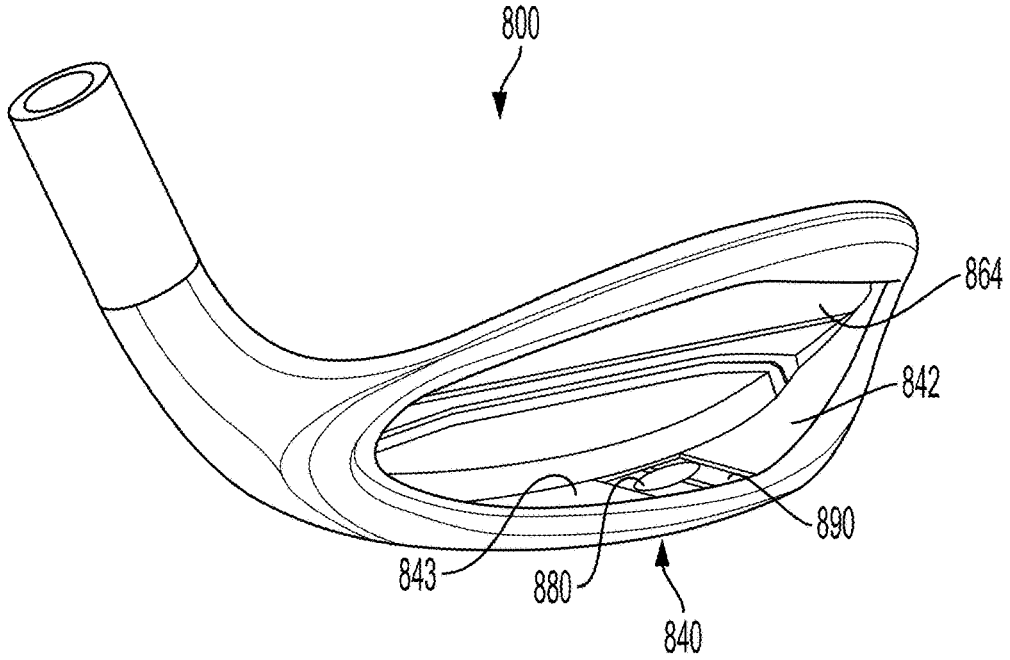
FIG. 8 is a rear view of an exemplary golf club head with a center of gravity adjustable along a depth axis.

Referring to FIG. 8, a golf club head 800 includes a rearwardly extending sole portion 840 including rear portion 843 extending rearwardly from the rear surface 864 and defining a sole cavity 842. A track member 890 extends along an upwardly facing surface generally rearwardly from the rear surface 864 along the sole portion 840. At least a portion of the track member 890 is non-parallel to the face plane of the golf club head 800 defined by a striking face opposite rear surface 864. A translatable weight member 880 mounted on the track member 890 is used to adjust the CGD of the golf club head 800. As a user translates the weight member 880 more rearwardly along the track member 890, the associated CGD of the golf club head 890 increases (i.e., becomes more positive). Thus, when the weight member 880 is positioned farther from the rear surface 864, the associated CGD is more positive than when the weight member 880 is positioned more adjacent to the rear surface 864. In other embodiments, the track member extends along a lower surface of the sole portion.

The track member 890 is up to 30 mm in length. In a preferred embodiment, the track member 890 is between 15 mm and 25 mm in length. The magnitude of CGD can be adjusted by up to 10 mm. The maximum CGD change by translating the weight member is at least 3 mm. In one or more embodiments, the maximum CGD change is at least 5 mm.

In one or more embodiments, the CGD increases linearly with rearward displacement of the weight member. In such embodiments, the track member extends parallel to the depth axis of the golf club head.

Figure 9:
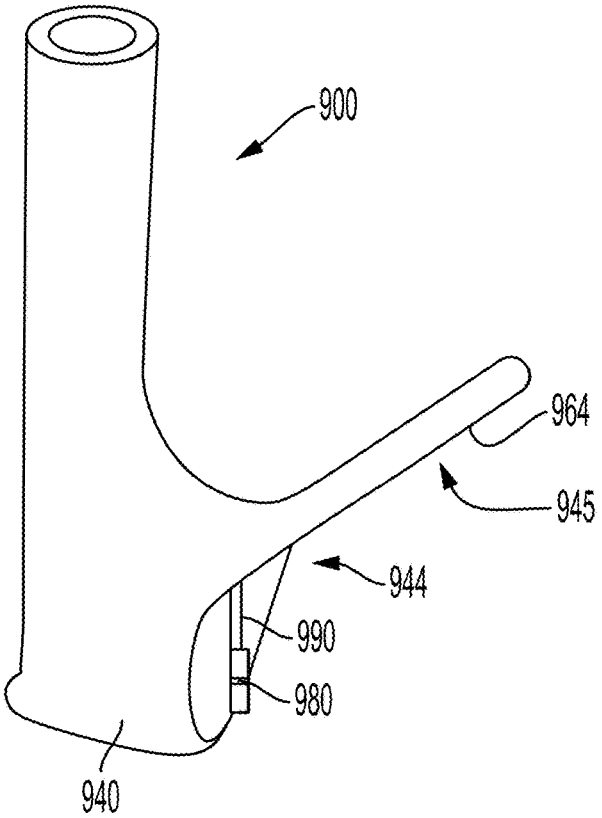
FIG. 9 is a heel side view of another exemplary golf club head with a center of gravity adjustable along a depth axis.

FIG. 9 shows an exemplary golf club head 900 having a muscle portion 944 located towards a sole portion 940 and a blade portion 945 constituting a top portion of the club head. A track member 990 extends generally downward along a surface of the muscle portion 944. A translatable weight member 980 mounted on the track member 990 is used to adjust the CGD of the golf club head 900. As a user translates the weight member 980 away from a blade portion of the golf club head along the track member 990, the associated CGD of the golf club head 900 increases (i.e., becomes more positive). Thus, when the weight member 980 is positioned farther from the blade portion 945, the associated CGD is more positive than when the weight member 980 is positioned more adjacent to the blade portion 945.

In embodiments of the disclosure where the depth of CG is adjustable, such as those shown in FIGS. 8 and 9, it is possible that the CG is located forward of the golf club head's striking face when the weight member is positioned adjacent to the rear surface. When the weight member is positioned farther away from the rear surface, the CG location of the golf club head can shift rearward of the striking face. In other words, in one or more embodiments, a golf club head has a CGD that can be flipped from a negative value to a positive value by positioning a translatable, track-mounted weight member closer or farther, respectively, from the golf club head's rear surface.

In one or more embodiments of a CGD adjustable golf club head, at least a portion of a track member is non-parallel to a face plane of the golf club head. For example, when the golf club 800 in FIG. 8 is in a reference position, at least a portion of the track member 890 may extend horizontally. In other embodiments, the track member 890 may also extend laterally in a heel-to-toe direction to provide adjustability of the CGO as described above. In yet other embodiments of a CGD adjustable golf club head, a secondary track member may extend from a toe portion of the rear surface toward a heel portion with a secondary weight member translatable along the secondary track member to adjust the CG with a lateral CG offset. In this regard, one or more of the track members disclosed herein may be provided in a golf club head of the present disclosure with another track member. For example, any of the track member arrangements shown in FIGS. 2 to 7 may be used in conjunction with track member 890 of FIG. 8.

As another example, when the golf club head 900 in FIG. 9 is in a reference position, at least a portion of the track member 990 may extend vertically. In other embodiments, the track member 990 may also extend laterally in a heel-to-toe direction to provide adjustability of the CGO as described above.

A sufficiently dense material is necessary to effectively change a golf club head's CG location. A translatable weight member according to the embodiments described above can have densities equal to or greater than a density of a main body of the golf club head. In preferred embodiments, the weight density is greater than 7,750 kg/m$^3$. For example, a translatable weight member can comprise mainly stainless steel, tungsten, or a tungsten alloy. In some embodiments, the weight member comprises more than one material and one side of the weight member may be heavier than another such that rotation of the weight member provides an additional degree of CG adjustability.

A translatable weight member can have a mass of up to 50 g and is at least 5 g. Preferably, the mass is between 15 g and 40 g. This particular range ensures the mass is sufficient to alter the center of gravity location of the club head in a manner effective to counter-act a common degree of slice or draw, effect an appreciable reduction or addition of spin to an impacted golf ball, and/or increment swingweight by at least one standard swingweight interval. The weight member may be circular or may be another shape. By configuring the weight member to exhibit a non-circular planer shape, e.g. a polygonal shape such as a square or hexagon, the weight member may bear built-in rotation-inhibiting attributes relative to the track member in which it is located, which may add to the secure placement of the weight member.

According to some embodiments, a track member comprises a groove or a rib. In one or more embodiments, the track member is recessed from the surrounding surface such that a weight member surface is flush. The translatable weight member comprises a coupling member that allows the weight member to be retained onto the track member and for the weight member to be translated to any point along the track member. For example, the track member may comprise a rib having a T-shaped cross-section and the coupling member may comprise a compatibly shaped groove.

According to the USGA Rules, all parts of a golf club head must be fixed. In other words, no part of a golf club head may exhibit movement relative to any other part thereof when subject to an external force. In the above embodiments, a fastening member, such as a set screw, locks the weight member onto a position of the track member so that the weight member is stationary when the golf club head is in use. The fastening member need not be discrete and may be integrated as part of the translatable weight member.

In contrast to other mass adjustable golf clubs, such as those incorporating interchangeable weight members in a limited number of fixed weight ports, by providing an adjustable CG location through the coupling of one or more translatable weight members to one or more track members on a rear side of the golf club head, golfers can tune the mass distribution of a golf club head to any point within a range of configurations. In doing so, golfers can, for example, optimize moments of inertia of the golf club head (e.g., about a vertical axis through the golf club head's CG, Izz, or about a horizontal axis through the golf club head's CG parallel to the face, Ixx) to match their swing tendencies and swing speed, and thus optimize the golf club head's feel during a swing. In embodiments of the golf club head where the weight member is translated generally laterally, Izz can be adjusted by up to 1,200 g*cm$^2$. In embodiments where the weight member is translated generally from a topline to sole direction, the Ixx can be adjusted by up to 500 g*cm$^2$.

For example, Table 1 lists physical properties of an exemplary golf club head having a rear surface track mounted weight member that is translatable laterally (i.e., in a heel to toe direction). The weight member has a mass of 35 g that is positioned at the center, heel end, or toe end of the track member for the data shown. Importantly, translating the weight member laterally shifts the CGO and changes the MOI about a vertical axis through the CG, Izz, by up to 852 g*cm$^2$ while the MOI about a horizontal axis through the CG (parallel to face) remains relatively unchanged.

TABLE 1

| Weight Member Position | CG Offset (mm) | Izz (g * cm$^2$) | Ixx (g * cm$^2$) |
|---|---|---|---|
| Center | 7 | 3266 | 1079 |
| Heel end | 1 | 3245 | 1129 |
| Toe end | 12 | 4118 | 1126 |

In one or more embodiments, a wedge-type golf club head having a track mounted weight member has an adjustable CGD and an adjustable MOI. In these embodiments, translating the weight member to increase CGD effectively increases the golf club head's Izz by up to 1,000 g*cm$^2$. Preferably, a maximum Izz change of such a CGD adjustable golf club head is at least 250 g*cm$^2$. Even more preferably, the maximum Izz change is at least 500 g*cm$^2$.

Golfers may also prefer to adjust the golf club head's CG location to account for playing conditions. For example, factors such as course moisture level and wind speeds can favor golf shots with a certain level of spin. Advantageously, a CG adjustable wedge-type golf club provides for such customization without the need, for example, to affix lead tape.

Figure 10:
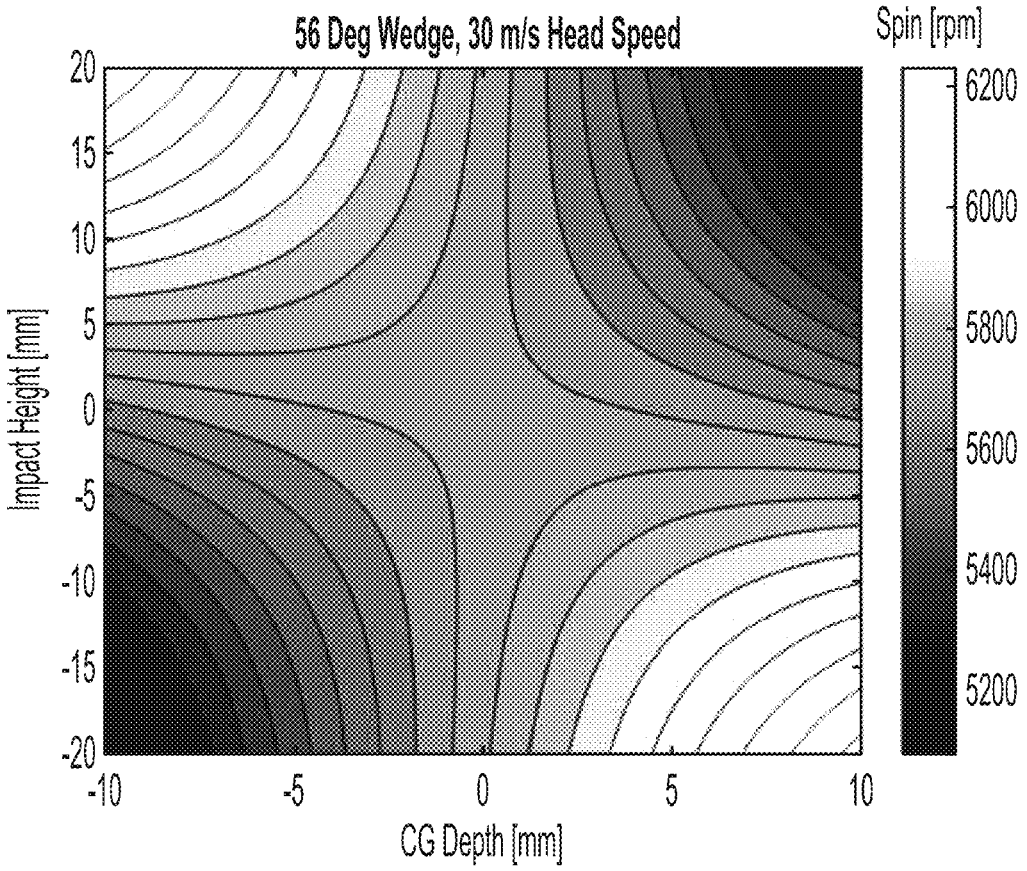
FIG. 10 is a contour map of a region of a golf club face simulating spin imparted on a golf ball upon impact.

The contour plot shown in FIG. 10 illustrates the significance of CGD on a golf shot from a wedge-type golf club head. In the plot, which simulates spin imparted by laterally-centered (i.e., aligned with the club head's CG) golf shots from golf club heads having 56 degrees of loft, shots from a club head with positive values of CGD exhibit gear effect: spin decreases with higher impact upon the face. Shots from a club head with a negative value of CGD exhibit reverse gear effect: spin increases with higher impact upon the face. Thus, by using a CGD adjustable golf club head, it is possible to match a spin preference with swing tendencies. This particular relationship, i.e. CGD and resulting spin generation, is of particular use in the case of a wedge-type club head, as shot dispersion and proximity to say a cup is a significant concern. Thus, the related weight track configurations discussed herein may be considered to be particularly suitable for wedge type club heads, e.g. iron type club heads having lofts greater than 44°.

While the track members shown in the drawings extend linearly, curvilinear track members are also possible to accommodate various shapes, surface contours, and weight distributions in golf club heads and thus may vary to a degree from optimal orientation without being considered to deviate from the spirit of this disclosure.

Although the golf club heads shown in FIGS. 1-9 and described in the embodiments above are discussed with respect to conventional usage as a wedge-type golf club head, these golf club heads may be another type of a golf club head such as a mid or short iron-type golf club head. Also, while the illustrated golf club heads are depicted as being a right-handed golf club head, any reference to any position on the golf club heads may be mirrored, and applied to left-handed golf club heads.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

We claim:

1. A golf club head that, when oriented in a reference position, comprises:

a loft greater than or equal to 40 degrees;

a main body including:

a topline portion;

a sole portion opposite the topline portion;

a heel portion;

a toe portion opposite the heel portion;

a striking face defining a face plane and extending between the topline portion and the sole portion and laterally between the heel portion and the toe portion, the striking face comprising a face center;

a rear surface opposite the striking face; and a muscle portion adjacent the rear surface and located towards the sole portion;

a track member that is at least partially nonparallel to the face plane and extends along a surface of the muscle portion; and a weight member translatable along the track member such that the golf club head has, in a first configuration, a first center of gravity (CG) defining a negative first CG depth when the weight member is located in a first position along the track member, and, in a second configuration, a second center of gravity defining a second CG depth when the weight member is located in a second position along the track member that is farther from the striking face and the rear surface than the first position, the second CG depth being greater than the first CG depth, wherein CG depth is measured normal to the face plane such that positive depth corresponds with locations rearward of the face plane and negative depth corresponds with locations forward of the face plane.

2. The golf club head of claim 1, wherein the second CG depth is a positive value.

3. The golf club head of claim 1, wherein a difference between the first CG depth and the second CG depth is at least 3 mm.

4. The golf club head of claim 1, wherein a difference between the first CG depth and the second CG depth is between 5 mm and 10 mm.

5. The golf club head of claim 1, wherein the golf club head has a first Izz in the first configuration and a second Izz in the second configuration, the second Izz being at least 250 g*cm$^2$ greater than the first Izz.

6. The golf club head of claim 1, wherein the golf club head has a first Izz in the first configuration and a second Izz in the second configuration, the second Izz being between 500 g*cm$^2$ and 1,000 g*cm2 greater than the first Izz.

7. The golf club head of claim 1, further comprising a secondary track member extending from the toe portion of the rear surface toward the heel portion, and a secondary weight member translatable along the secondary track member, wherein:

in a first position of the secondary weight member along the secondary track member, the golf club head has a first CG offset; and in a second more toe-ward position of the secondary weight member along the secondary track member, the golf club head has a second CG offset less than the first CG offset.

8. The golf club head of claim 7, wherein a CG horizontal distance, defined as the absolute difference between the first CG offset and the second CG offset, is at least 4 mm.

9. The golf club head of claim 8, wherein the CG horizontal distance is up to 20 mm.

10. The golf club head of claim 1, wherein the weight member comprises a mass between 15 g and 40 g.

11. A golf club head that, when oriented in a reference position, comprises:

a loft greater than or equal to 40 degrees;

a main body including:

a striking face defining a face plane and comprising a face center;

a rear surface opposite the striking face;

a topline portion;

a sole portion opposite the topline portion, the sole portion including a rear portion extending rearwardly from the rear surface;

a heel portion; and a toe portion opposite the heel portion;

a track member that extends rearwardly along a surface of the sole portion and is, at least partially, non-parallel to the face plane; and a weight member translatable along the track member such that the golf club head has, in a first configuration, a first center of gravity (CG) defining a first CG depth when the weight member is located in a first position along the track member, and, in a second configuration, a second center of gravity defining a second CG depth when the weight member is located in a second position along the track member that is farther from the striking face than the first position, the second CG depth being greater than the first CG depth, wherein CG depth is measured normal to the face plane such that positive depth corresponds with locations rearward of the face plane and negative depth corresponds with locations forward of the face plane.

12. The golf club head of claim 11, wherein the first CG depth is a negative value and the second CG depth is a positive value.

13. The golf club head of claim 11, wherein a difference between the first CG depth and the second CG depth is at least 3 mm.

14. The golf club head of claim 11, wherein the surface of the rear portion is an upwardly facing surface.

15. The golf club head of claim 11, wherein the golf club head has a first Izz in the first configuration and a second Izz in the second configuration, the second Izz being at least 250 $g*cm^2$ greater than the first Izz.

16. The golf club head of claim 11, wherein the golf club head has a first Izz in the first configuration and a second Izz in the second configuration, the second Izz being between 500 $g*cm^2$ and 1,000 g*cm2 greater than the first Izz.

17. The golf club head of claim 11, further comprising a secondary track member extending from the toe portion of the rear surface toward the heel portion, and a secondary weight member translatable along the secondary track member, wherein:

in a first position of the secondary weight member along the secondary track member, the golf club head has a first CG offset;

in a second more toe-ward position of the secondary weight member along the secondary track member, the golf club head has a second CG offset less than the first CG offset.

18. The golf club head of claim 17, wherein a CG horizontal distance, defined as the absolute difference between the first CG offset and the second CG offset, is at least 4 mm.

19. The golf club head of claim 18, wherein the CG horizontal distance is up to 20 mm.

20. The golf club head of claim 19, wherein the weight member comprises a mass between 15 g and 40 g.

* * * * *